US010056736B2

(12) United States Patent
Ikeda

(10) Patent No.: US 10,056,736 B2
(45) Date of Patent: Aug. 21, 2018

(54) HIGH-FREQUENCY RADIATION PLUG

(75) Inventor: Yuji Ikeda, Kobe (JP)

(73) Assignee: IMAGINEERING, INC., Hyogo (JP)

( * ) Notice: Subject to any disclaimer, the term of this patent is extended or adjusted under 35 U.S.C. 154(b) by 166 days.

(21) Appl. No.: 14/343,471

(22) PCT Filed: Sep. 10, 2012

(86) PCT No.: PCT/JP2012/073104
§ 371 (c)(1),
(2), (4) Date: Apr. 7, 2014

(87) PCT Pub. No.: WO2013/035880
PCT Pub. Date: Mar. 14, 2013

(65) Prior Publication Data

US 2014/0232264 A1 Aug. 21, 2014

(30) Foreign Application Priority Data

Sep. 11, 2011 (JP) ..... 2011-197761

(51) Int. Cl.
*F02P 5/00* (2006.01)
*H01T 13/20* (2006.01)
(Continued)

(52) U.S. Cl.
CPC ..... *H01T 13/20* (2013.01); *F02P 23/04* (2013.01); *F02P 23/045* (2013.01); *H01T 13/50* (2013.01);
(Continued)

(58) Field of Classification Search
CPC ..... F02P 23/045; F02P 9/007; H05H 1/46; F02M 27/042; H01T 13/08
(Continued)

(56) References Cited

U.S. PATENT DOCUMENTS 3,939,816 A * 2/1976 Espy ..... H05H 1/52 124/3
4,774,914 A * 10/1988 Ward ..... F02P 15/04 123/162
(Continued)

FOREIGN PATENT DOCUMENTS

JP 2010-96109 A 4/2010
JP 2012-127286 A 7/2012

*Primary Examiner* — Marguerite McMahon
*Assistant Examiner* — Tea Holbrook
(74) *Attorney, Agent, or Firm* — Westerman, Hattori, Daniels & Adrian, LLP

(57) ABSTRACT

An aim of the present invention is, in a plug for high frequency emission disposed at an end of a casing having an emission antenna, to suppress a high frequency noise emitted from the emission antenna. The present invention is directed to a plug for high frequency emission including a transmission line for transmitting an electromagnetic wave, an emission antenna for emitting the electromagnetic wave supplied via the transmission line, and a casing constituted by a cylindrical shaped conductor, provided with the emission antenna at one end of the casing, and accommodating therein the transmission line extending from the emission antenna toward the other end of the casing. Inside of the casing, a central conductor electrically connected to the emission antenna and an outer conductor spaced apart from and surrounding the central conductor are embedded in an insulator so as to collectively constitute the transmission line, and the outer conductor is disposed in and held in non-contact with the casing.

2 Claims, 6 Drawing Sheets

(51) Int. Cl.

| | |
|---|---|
| ***F02P 23/04*** | (2006.01) |
| ***H01T 13/50*** | (2006.01) |
| *F02P 15/04* | (2006.01) |
| *H01T 13/44* | (2006.01) |
| *H05H 1/46* | (2006.01) |
| *F02P 3/02* | (2006.01) |
| *F02P 9/00* | (2006.01) |

(52) U.S. Cl.
CPC ..... *H05H 1/46* (2013.01); *F02P 3/02* (2013.01); *F02P 9/007* (2013.01); *F02P 15/04* (2013.01); *H01T 13/44* (2013.01); *H05H 2001/463* (2013.01)

(58) Field of Classification Search
USPC ..... 123/143 B; 315/34
See application file for complete search history.

(56) References Cited

U.S. PATENT DOCUMENTS 5,076,223 A * 12/1991 Harden ..... H01T 13/50 123/143 B
6,414,419 B1 * 7/2002 Kim ..... H01T 13/20 313/139
6,581,581 B1 * 6/2003 Bebich ..... F02P 23/045 123/536
7,719,476 B2 * 5/2010 Ke ..... H01Q 1/362 343/702
8,887,683 B2 * 11/2014 Smith ..... F02P 9/007 123/143 B
2009/0227168 A1 * 9/2009 Nakamura ..... H01T 21/02 445/7
2009/0229581 A1 * 9/2009 Ikeda ..... B01D 53/32 123/536
2010/0187968 A1 * 7/2010 Ikeda ..... F02P 23/045 313/134
2010/0212620 A1 * 8/2010 Shimizu ..... F02P 9/007 123/143 B
2011/0254429 A1 * 10/2011 Kameda ..... H01T 13/50 313/141
2012/0212131 A1 * 8/2012 Kameda ..... H01T 13/50 315/71
2013/0019841 A1 * 1/2013 Ando ..... F02D 41/3041 123/406.12

* cited by examiner

HIGH-FREQUENCY RADIATION PLUG

TECHNICAL FIELD

The present invention relates to a plug for high frequency emission provided at one end of a casing thereof with an emission antenna.

BACKGROUND ART

Conventionally, there is known a plug for high frequency emission provided at one end of a casing thereof with an emission antenna. For example, Japanese Unexamined Patent Application, Publication No. 1983-213120 discloses a glow plug attached to a diesel engine as this kind of a plug for high frequency emission.

The glow plug disclosed in the Japanese Unexamined Patent Application, Publication No. 1983-213120 includes an outer conductor in the form of a tube-like shape, an inner conductor passing through an axial center of the outer conductor, a resistance wire connected to the outer conductor and the inner conductor respectively in a substantially integrated manner, and a dielectric filled between the outer conductor and the inner conductor. The outer conductor is formed, at an outer peripheral part thereof, with a thread for attachment to a cylinder head. The resistance wire is protruded toward the inside of a combustion chamber and formed to be a loop-like shaped antenna for microwave emission.

PRIOR ART DOCUMENTS

Patent Documents

Patent Document 1: Japanese Unexamined Patent Application, Publication No. 1983-213120

THE DISCLOSURE OF THE INVENTION

Problems to be Solved by the Invention

In a conventional plug for high frequency emission, a casing (thereof) is used as an outer conductor of a transmission line. Therefore, when an electric current flows through a target object attached with the plug for high frequency emission, there is a concern that the electric current may cause a high frequency noise emitted from an emission antenna.

For example, when the plug for high frequency emission is attached to an internal combustion engine, a ground conductor of an ignition plug is electrically connected to a cylinder head of the internal combustion engine. Accordingly, there is a concern that an electric current may flow through the cylinder head accompanied with a spark discharge. The electric current may then cause a high frequency noise emitted from the emission antenna via the casing.

The present invention has been made in view of the above described problems, and it is an object of the present invention, in a plug for high frequency emission provided at one end of a casing thereof with an emission antenna, to suppress a high frequency noise emitted from the emission antenna.

Means for Solving the Problems

In accordance with a first aspect of the present invention, there is provided a plug for high frequency emission including: a transmission line for transmitting an electromagnetic wave; an emission antenna for emitting the electromagnetic wave supplied via the transmission line; and a casing constituted by a cylindrical shaped conductor. The casing is provided with the emission antenna at one end of the casing, and accommodates therein the transmission line extending from the emission antenna toward the other end of the casing. Inside of the casing, a central conductor electrically connected to the emission antenna and an outer conductor spaced apart from and surrounding the central conductor are embedded in an insulator so as to collectively constitute the transmission line, and the outer conductor is disposed in the casing in a manner to be held in non-contact with the casing.

According to the first aspect of the present invention, in the plug for high frequency emission, the outer conductor of the transmission line is disposed in the casing in a manner to be held in non-contact with the casing. As a result thereof, the outer conductor is not electrically conducted via the casing constituted by the conductor to a target object attached with the plug For high frequency emission.

In accordance with a second aspect of the present invention, in addition to the first aspect of the present invention, a plate-like conductor is embedded between the emission antenna and the outer conductor in the insulator of the transmission line in a mariner to be held in non-contact with the central conductor without electrically connecting between the outer conductor and the casing. The plate-like conductor is greater in area than an end surface of the outer conductor on a side of the emission antenna.

According to the second aspect of the present invention, the plate-like conductor is embedded between the emission antenna and the outer conductor in the insulator of the transmission line. The plate-like conductor is greater in area than the end surface on the side of the emission antenna of the outer conductor, and thus, promotes emission of the electromagnetic wave from the emission antenna. The plate-like conductor is embedded in the insulator in a manner to be held in non-contact with the central conductor without electrically connecting between the outer conductor and the casing.

In accordance with a third aspect of the present invention, in addition to the second aspect of the present invention, the plate-like conductor is formed in a shape of a ring or a letter C, and is embedded in the insulator in a manner to surround the central conductor.

According to the third aspect of the present invention, the plate-like conductor in the shape of a ring or a letter C is embedded in the insulator in a manner to surround the central conductor.

Effect of the Invention

According to the present invention, in the plug for high frequency emission, since the outer conductor of the transmission line is held in non-contact with the casing, the outer conductor is not electrically conducted via the casing to a target object attached with the plug for high frequency emission. Accordingly, even though an electric current flows through the target object attached with the plug for high frequency emission, the electric current does not flow via the casing to the outer conductor. Therefore, it is possible to suppress a high frequency noise emitted from the emission antenna resulted from the electric current flowing through the target object.

BEST MODE FOR CARRYING OUT THE INVENTION

Figure 1:
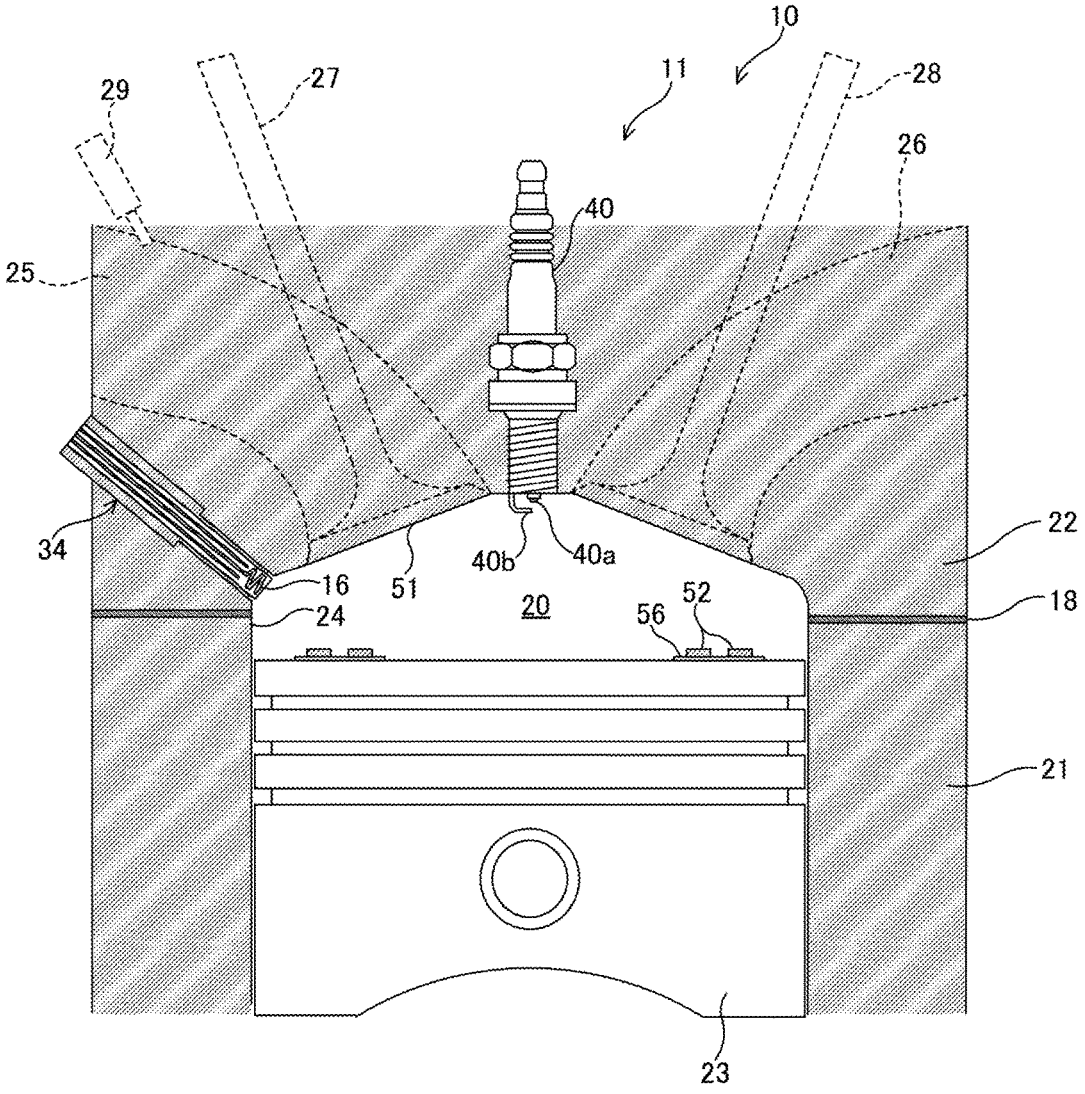
FIG. 1 is a vertical cross sectional view of an internal combustion engine according to an embodiment.

In the following, a detailed description will be given of an embodiment of the present invention with reference to drawings. It should be noted that the following embodiment is merely a preferable example, and does not limit the scope of the present invention, applied field thereof, or application thereof.

The present embodiment is directed to an internal combustion engine 10 according to the present invention. The internal combustion engine 10 is a reciprocating type internal combustion engine in which pistons 23 reciprocate. The internal combustion engine 10 includes an internal combustion engine main body 11, an ignition device 12, an electromagnetic wave emission device 13, and a control device 35. In the internal combustion engine 10, a combustion cycle in which an air fuel mixture is ignited and combusted by the ignition device 12 is repeatedly carried out.

<Internal Combustion Engine Main Body>

As shown in FIG. 1, the internal combustion engine main body 11 includes a cylinder block 21, a cylinder head 22, and the pistons 23. The cylinder block 21 is formed with a plurality of cylinders 24 each having a circular cross section. Inside of each cylinder 24, the piston 23 is reciprocatably mounted. The piston 23 is connected to a crankshaft (not shown) via a connecting rod (not shown). The crankshaft is rotatably supported by the cylinder block 21. While the piston 23 reciprocates in each cylinder 24 in an axial direction of the cylinder 24, the connecting rod converts the reciprocal movement of the piston 23 to rotational movement of the crankshaft.

The cylinder head 22 is placed on the cylinder block 21, and a gasket 18 intervenes between the cylinder block 21 and the cylinder head 22. The cylinder head 22 constitutes a partitioning member that partitions a combustion chamber 20 having a circular cross section, along with the cylinder 24, the piston 23, and the gasket 18. A diameter of the combustion chamber 20 is, for example, approximately equal to a half wavelength of a microwave emitted to the combustion chamber 20 by the electromagnetic wave emission device 13.

Figure 2:
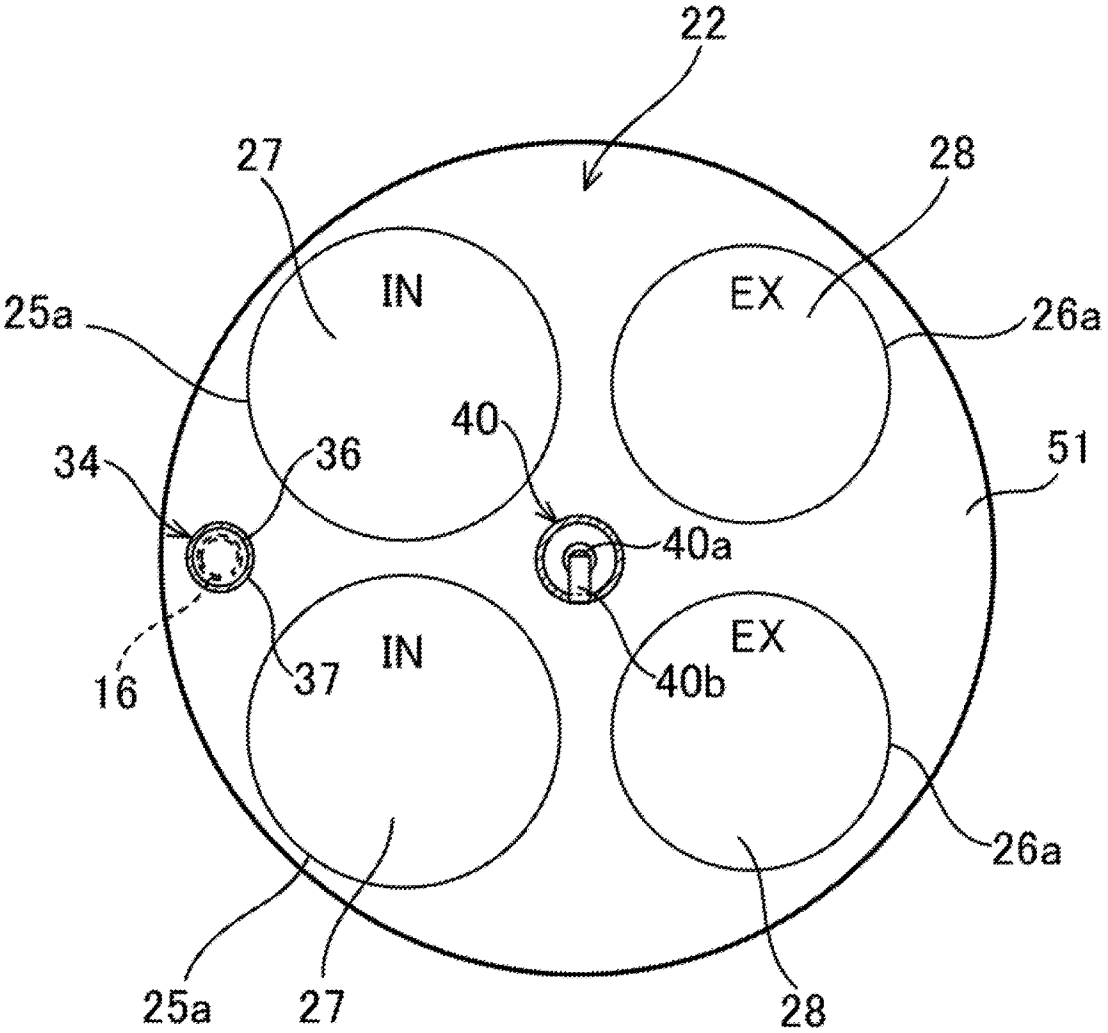
FIG. 2 is a front view of a ceiling surface of a combustion chamber of the internal combustion engine according to the embodiment.

The cylinder head 22 is provided with one ignition plug 40 that constitutes a part of the ignition device 12 for each cylinder 24. As shown in FIG. 2, a tip end part of the ignition plug 40 is exposed toward the combustion chamber 20 and locates at a central part of a ceiling surface 51 of the combustion chamber 20. The ceiling surface 51 is a surface of the cylinder head 22 and exposed toward the combustion chamber 20. An outer periphery of the tip end part of the ignition plug 40 is circular viewed from an axial direction of the ignition plug 40. The ignition plug 40 is provided with a central electrode 40*a* and a ground electrode 40*b* at the tip end part of the ignition plug 40. A discharge gap is formed between a tip end of the central electrode 40*a* and a tip end of the ground electrode 40*b*.

The cylinder head 22 is formed with intake ports 25 and exhaust ports 26 for each cylinder 24. Each intake port 25 is provided with an intake valve 27 for opening and closing an intake side opening 25*a* of the intake port 25, and an injector 29 for injecting a fuel. On the other hand, each exhaust port 26 is provided with an exhaust valve 28 for opening and closing an exhaust side opening 26*a* of the exhaust port 26.

<Ignition Device>

Figure 3:
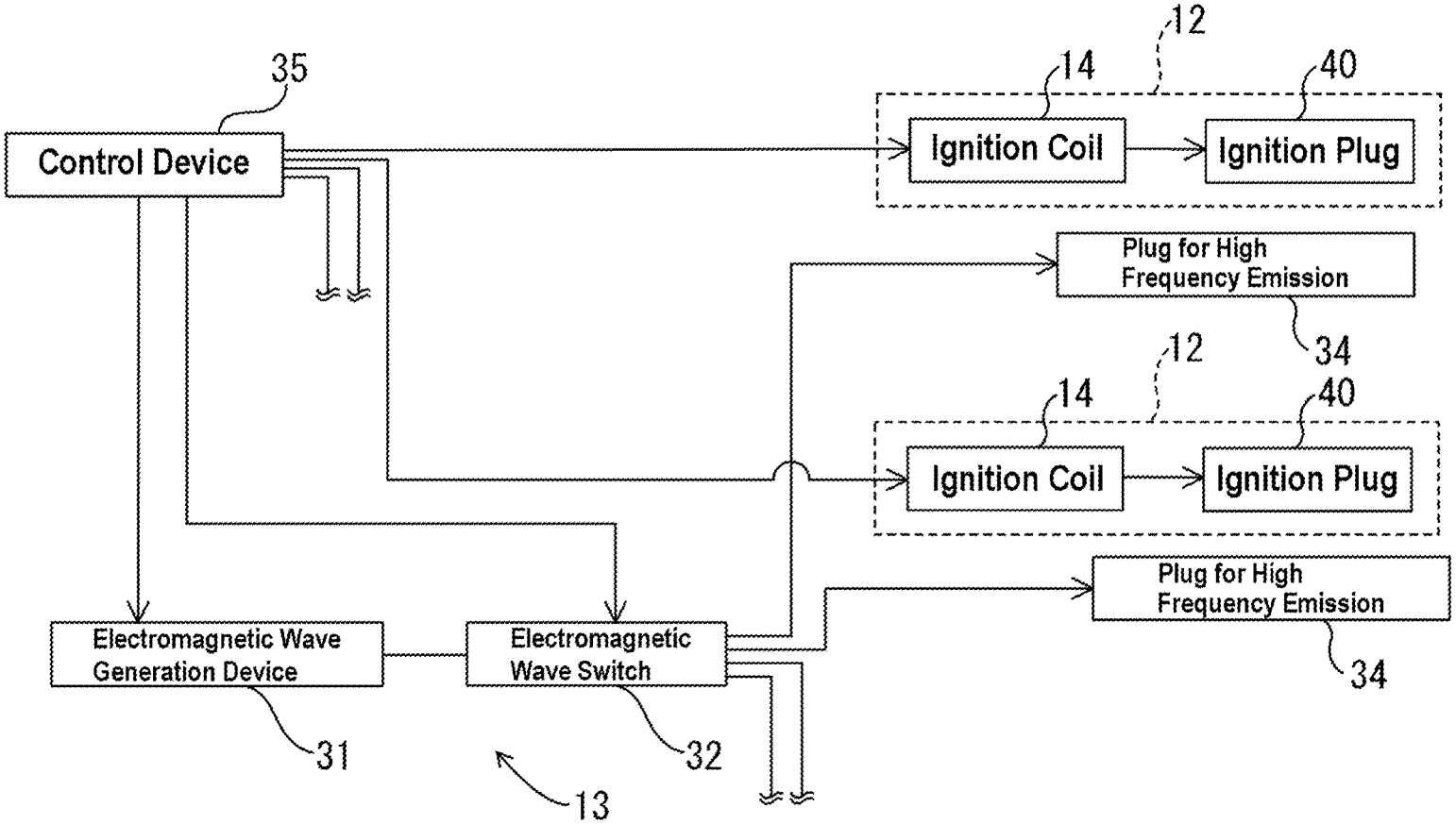
FIG. 3 is a block diagram of an ignition device and an electromagnetic wave emission device according to the embodiment.

The ignition device 12 is provided for each combustion chamber 20. As shown in FIG. 3, each ignition device 12 includes an ignition coil 14 that outputs a high voltage pulse, and the ignition plug 40 which the high voltage pulse outputted from the ignition coil 14 is supplied to.

The ignition coil 14 is connected to a direct current power supply (not shown). The ignition coil 14, upon receiving an ignition signal from the control device 35, boosts a voltage applied from the direct current power supply, and outputs the boosted high voltage pulse to the central electrode 40*a* of the ignition plug 40. The ignition plug 40, when the high voltage pulse is applied to the central electrode 40*a*, causes an insulation breakdown and a spark discharge to occur at the discharge gap. Along a discharge path of the spark discharge, discharge plasma is generated. The central electrode 40*a* is applied with a negative voltage as the high voltage pulse.

The ignition device 12 may include a plasma enlarging part that enlarges the discharge plasma by supplying the discharge plasma with electric energy. The plasma enlarging part enlarges the spark discharge, for example, by supplying the spark discharge with energy of a high frequency such as a microwave. By means of the plasma enlarging part, it is possible to improve stability of ignition even with a lean air fuel mixture. The electromagnetic wave emission device 13 may be utilized as the plasma enlarging part.

<Electromagnetic Wave Emission Device>

As shown in FIG. 3, the electromagnetic wave emission device 13 includes an electromagnetic wave generation device 31, an electromagnetic wave switch 32, and plugs for high frequency emission 34. One electromagnetic wave generation device 31 and one electromagnetic wave switch 32 are provided for the electromagnetic wave emission device 13, and the plug for high frequency emission 34 is provided for each combustion chamber 20.

The electromagnetic wave generation device 31, upon receiving an electromagnetic wave drive signal (a pulse signal) from the control device 35, continuously outputs a microwave during a period of time of the pulse width of the electromagnetic wave drive signal. In the electromagnetic wave generation device 31, a semiconductor oscillator generates the microwave. In place of the semiconductor oscillator, any other oscillator such as a magnetron may be employed.

The electromagnetic wave switch 32 includes an input terminal and a plurality of output terminals provided for the respective plugs for high frequency emission 34. The input terminal is electrically connected to the electromagnetic wave generation device 31. Each output terminal is electrically connected to an input terminal of the corresponding plug for high frequency emission 34. The electromagnetic wave switch 32 sequentially switches a supply destination of the microwave outputted from the electromagnetic wave generation device 31 from among the plurality of the plugs for high frequency emission 34 under a control of the control device 35.

Figure 4:
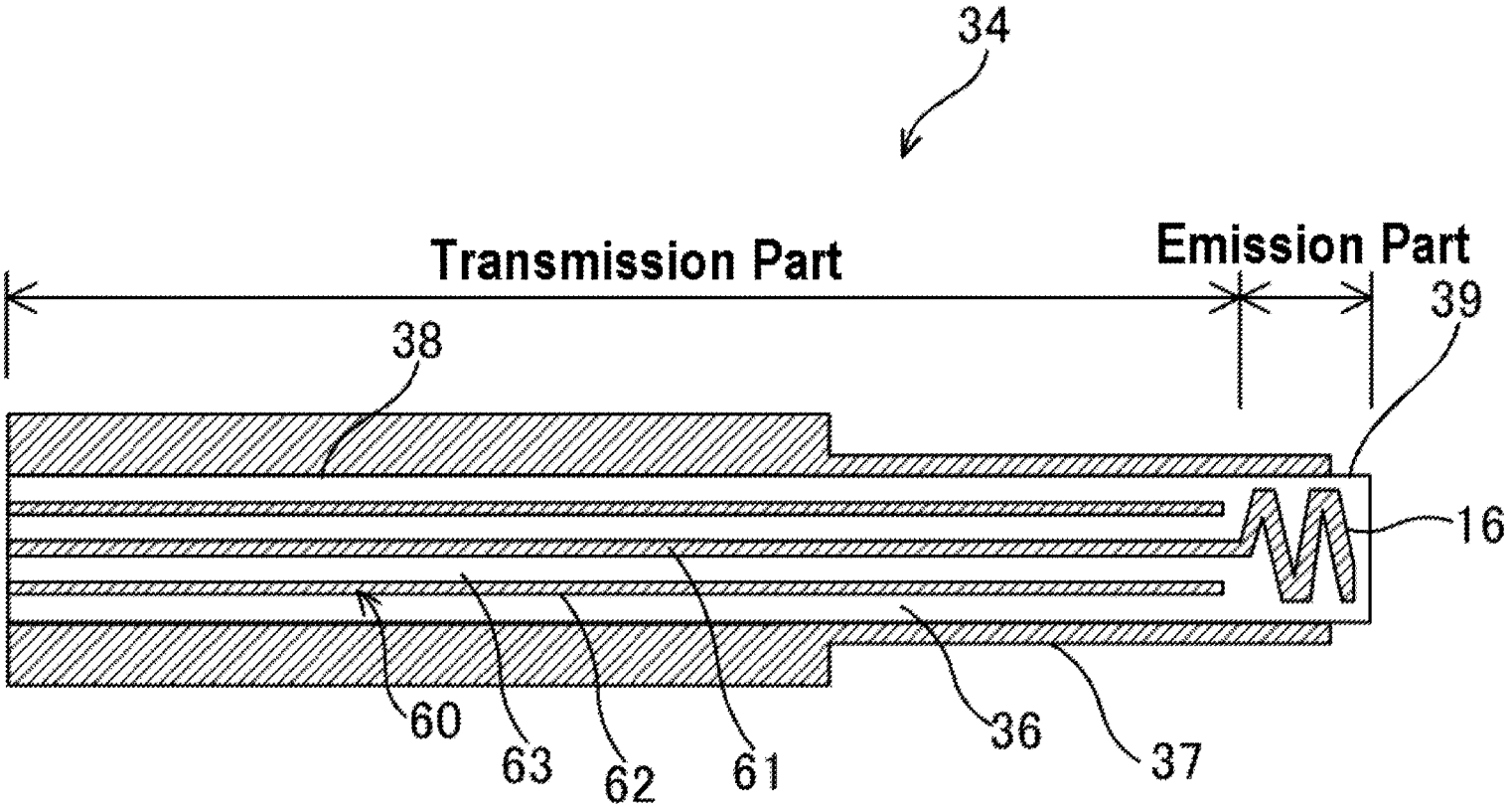
FIG. 4 is a vertical cross sectional view of a plug for high frequency emission according to the embodiment.

As shown in FIG. 1, the plug for high frequency emission 34 is formed in a substantially column-like shape as a whole. As shown in FIG. 4, the plug for high frequency emission 34 includes a ceramic structure 36 which is provided with a ceramic 63 (an electrical insulator) embedded with conductors, and a casing 37 that accommodates the ceramic structure 36.

The ceramic structure 36 is formed in a column-like shape. The ceramic structure 36 includes a transmission part 38 provided with a transmission line 60 of the microwave, and an emission part 39 provided with an emission antenna 16. The transmission part 38 and the emission part 39 are integrated with each other. The transmission part 38 occupies most of the ceramic structure 36. One end part of the ceramic structure 36 constitutes the emission part 39, and the rest constitutes the transmission part 33.

In the transmission part 38, a central conductor 61 and an outer conductor 62 that constitute the transmission line 60 of the microwave are embedded in the ceramic 63. The central conductor 61 is a linear conductor. The central conductor 61 is provided on an axial center of the ceramic structure 36 over an entire length of the transmission part 38. While, on the other hand, the outer conductor 62 is a conductor in a shape of a rectangular cylinder, for example. The outer conductor 62 surrounds the central conductor 61. The ceramic 63 is sandwiched between the outer conductor 62 and the central conductor 61. The outer conductor 62 is spaced apart at a constant distance from the central conductor 61 over an entire length of the outer conductor 62. Only one end of the outer conductor 62 is exposed from an end surface of the ceramic structure 36. In the plug for high frequency emission 34, one end of the transmission part 38 constitutes an input terminal of the microwave. The transmission part 38 transmits to the emission part 39 the microwave inputted from the input terminal while preventing the microwave from leaking to the outside of the outer conductor 62.

Meanwhile, in a case in which the ceramic structure 36 is manufactured by using a lamination technology disclosed in Japanese Unexamined Patent Application, Publication No. 1998-75108, the outer conductor 62 may be configured by combining a conductor layer and cylindrical conductors (via holes). In this case, the outer conductor 62 is configured to have adjacent cylindrical conductors spaced apart at such a distance in a transmission direction of the microwave that the microwave should not leak to the outside of the outer conductor 62.

In the emission part 39, the emission antenna 16 is embedded in the ceramic 63 so as not to expose to the outer face of the ceramic structure 36. This means that an entire surface of the emission antenna 16 is covered by the ceramic 63. The emission antenna 16 is a conductor formed in a helical shape. The emission antenna 16 is integrated at an input end thereof with the central conductor 61 of the transmission part 38.

The casing 37 is formed in a substantially cylindrical shape. An inner diameter of the casing 37 is uniform along an axial direction of the casing 37. The inner diameter of the casing 37 is approximately the same as an outer diameter of the ceramic structure 36. The ceramic structure 36 is fitted into the casing 37 in such a manner that an end surface of the emission part 39 is exposed from one end of the casing 37 and an end surface of the transmission part 38 is exposed from the other end of the casing 37. Apart of the emission part 39 is protruded from the one end of the casing 37 in such a manner that a part of the emission antenna 16 locates outside of the casing 37.

An outer diameter of the casing 37 changes at one location in the axial direction of the casing 37. An outer peripheral surface of the casing 37 is formed with a step only at the one location. The casing 37 is smaller in the outer diameter on a distal end side from which the emission part 39 is exposed than on a base end side from which the transmission part 38 is exposed.

The plug for high frequency emission 34 is attached to the cylinder head 22 in such a manner that the emission part 39 is exposed toward the combustion chamber 20. The plug for high frequency emission 34 is threaded into a fixing hole of the cylinder head 22. The plug for high frequency emission 34 is connected at an input terminal of the transmission part 38 to the output terminal of the electromagnetic wave switch 32 via a coaxial cable (not shown). In the plug for high frequency emission 34, when the microwave is inputted from the input terminal of the transmission part 38, the microwave passes through the inside of the outer conductor 62 of the transmission part 38. The microwave that has passed through the transmission part 38 is emitted from the emission antenna 16 to the combustion chamber 20.

In the plug for high frequency emission 34 according to the present embodiment, the outer conductor 62 is provided in the casing 37 in a non-contact manner. The outer conductor 62 is not electrically conducted via the casing 37, which is made of metal, to the cylinder head 22, which the plug for high frequency emission 34 is attached to. Accordingly, even though a spark current or the like flows through the cylinder head 22, the spark current or the like will not transmit via the casing 37 to the outer conductor 62.

In the internal combustion engine main body 11, the partitioning member that partitions the combustion chamber 20 is provided with a plurality of receiving antennae 52 that resonate with the microwave emitted from the emission antenna 16 to the combustion chamber 20. Each receiving antenna 52 is formed in a ring-like shape. As shown in FIG. 1, two receiving antennae 52 are provided on a top part of the piston 23. Each receiving antenna 52 is electrically insulated from the piston 23 via an insulation layer 56 formed on a top surface of the piston 23, and is provided in an electrically floating state.

<Operation of Control Device>

An operation of the control device 35 will be described hereinafter. The control device 35 performs a first operation of instructing the ignition device 12 to ignite the air fuel mixture and a second operation of instructing the electromagnetic wave emission device 13 to emit the microwave after the ignition of the air fuel mixture, for each combustion chamber 20 during one combustion cycle.

More particularly, the control device 35 performs the first operation at an ignition timing at which the piston 23 locates immediately before the compression top dead center. The control device 35 outputs the ignition signal as the first operation.

The ignition device 12, upon receiving the ignition signal, causes the spark discharge to occur at the discharge gap of the ignition plug 40, as described above. The air fuel mixture is ignited by the spark discharge. When the air fuel mixture is ignited, the flame spreads from an ignition location of the air fuel mixture at a central part of the combustion chamber 20 toward a wall surface of the cylinder 24.

The control device 35 performs the second operation after the ignition of the air fuel mixture, for example, at a start timing of a latter half period of flame propagation. The control device 35 outputs the electromagnetic wave drive signal as the second operation.

The electromagnetic wave emission device 13, upon receiving the electromagnetic wave drive signal, causes the emission antenna 16 to emit a continuous wave (CW) of the microwave, as described above. The microwave is emitted during the latter half period of the flame propagation. An output timing and a pulse width of the electromagnetic wave drive signal are configured such that the microwave is emitted over a period in which the flame passes through a region where the two receiving antennae 52 are provided.

The microwave resonates with each receiving antenna 52. In the vicinity of each receiving antenna 52, a strong electric field region having an electric field relatively strong in intensity in the combustion chamber 20 is formed over the latter half period of the flame propagation. The flame, while passing through the strong electric field region, receives energy of the microwave and accelerates its propagation speed.

In a case in which the microwave energy is high, microwave plasma is generated in the strong electric field region. In a region where the microwave plasma is generated, active species such as OH radicals are generated. The propagation speed of the flame increases as the flame passes through the strong electric field region owing to the active species.

<Effect of Embodiment>

According to the present embodiment, in the plug for high frequency emission 34, since the outer conductor 62 of the transmission line 60 does not contact with the casing 37, the outer conductor 62 is not electrically conducted via the casing 37 to the cylinder head 22 attached with the plug for high frequency emission 34. Accordingly, even if an electric current flows through the cylinder head 22, the electric current does not transmit via the casing 37 to the outer conductor 62. Therefore, it is possible to suppress a noise in the microwave emitted from the emission antenna 16 resulted from the electric current flowing through the cylinder head 22.

<Modified Example of Embodiment>

Figure 5:
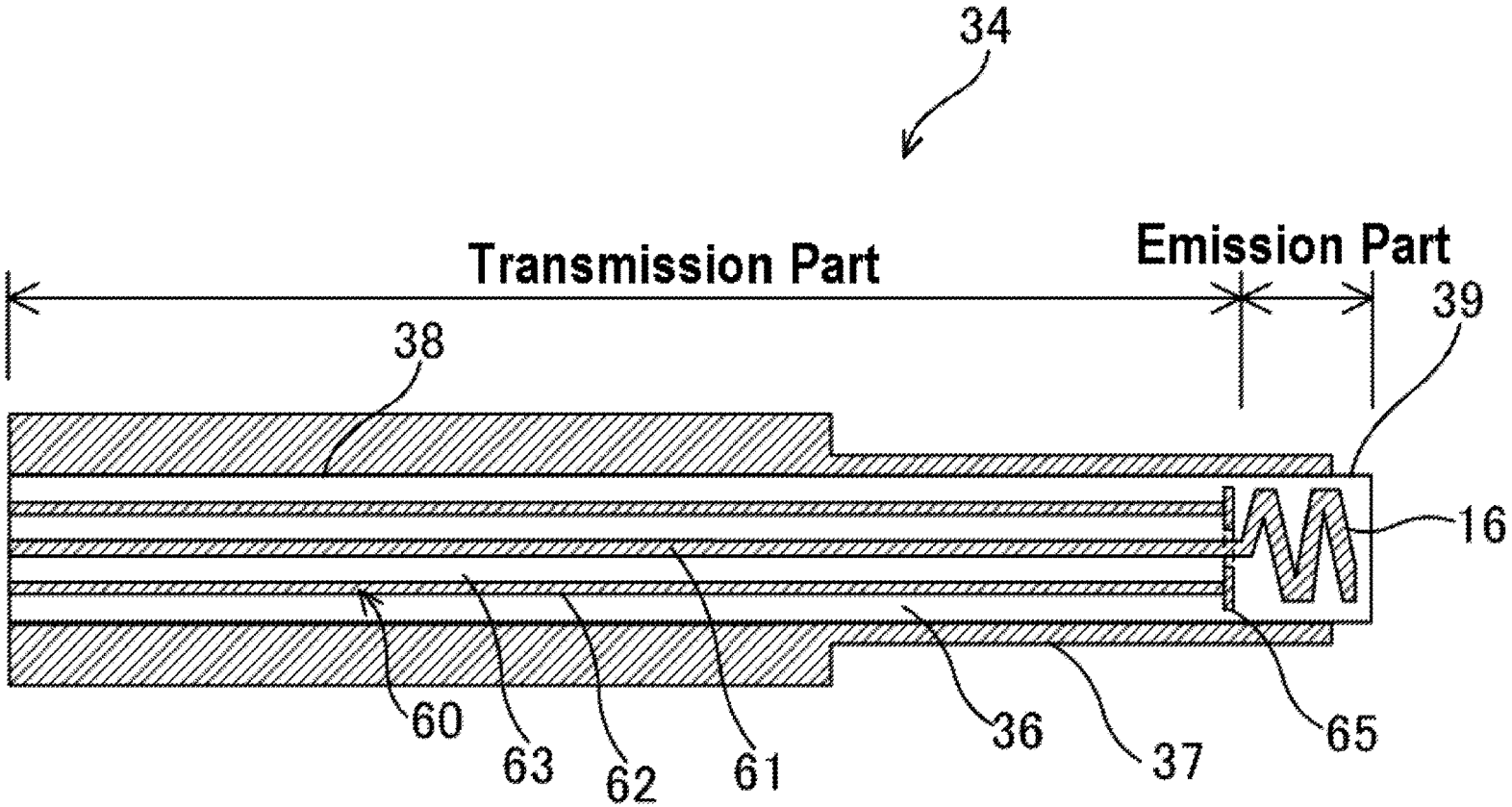
FIG. 5 is a vertical cross sectional view of a plug for high frequency emission according to a modified example of the embodiment.

According to the modified example of the embodiment, as shown in FIG. 5, a plate-like conductor 65 is embedded between the emission antenna 16 and the outer conductor 62 in the ceramic structure 36. The plate-like conductor 65 is wider in area than an end surface on a side of the emission antenna 16 of the outer conductor 62, and is adapted to improve emission efficiency of the microwave from the emission antenna 16.

The plate-like conductor 65 is formed in a shape of a ring or a letter C, and is embedded in the ceramic 63 spaced apart from and surrounding the central conductor 61. The plate-like conductor 65 is held in non-contact with the central conductor 61. The plate-like conductor 65 is provided along a cross sectional direction of the ceramic structure 36.

Furthermore, the plate-like conductor 65 abuts with the outer conductor 62 alone from among the outer conductor 62 and the casing 37 so that the outer conductor 62 is not electrically connected with the casing 37. The plate-like conductor 65 abuts with the end surface on the side of the emission antenna 16 of the outer conductor 62. The plate-like conductor 65 is electrically connected to the outer conductor 62.

Figure 6:
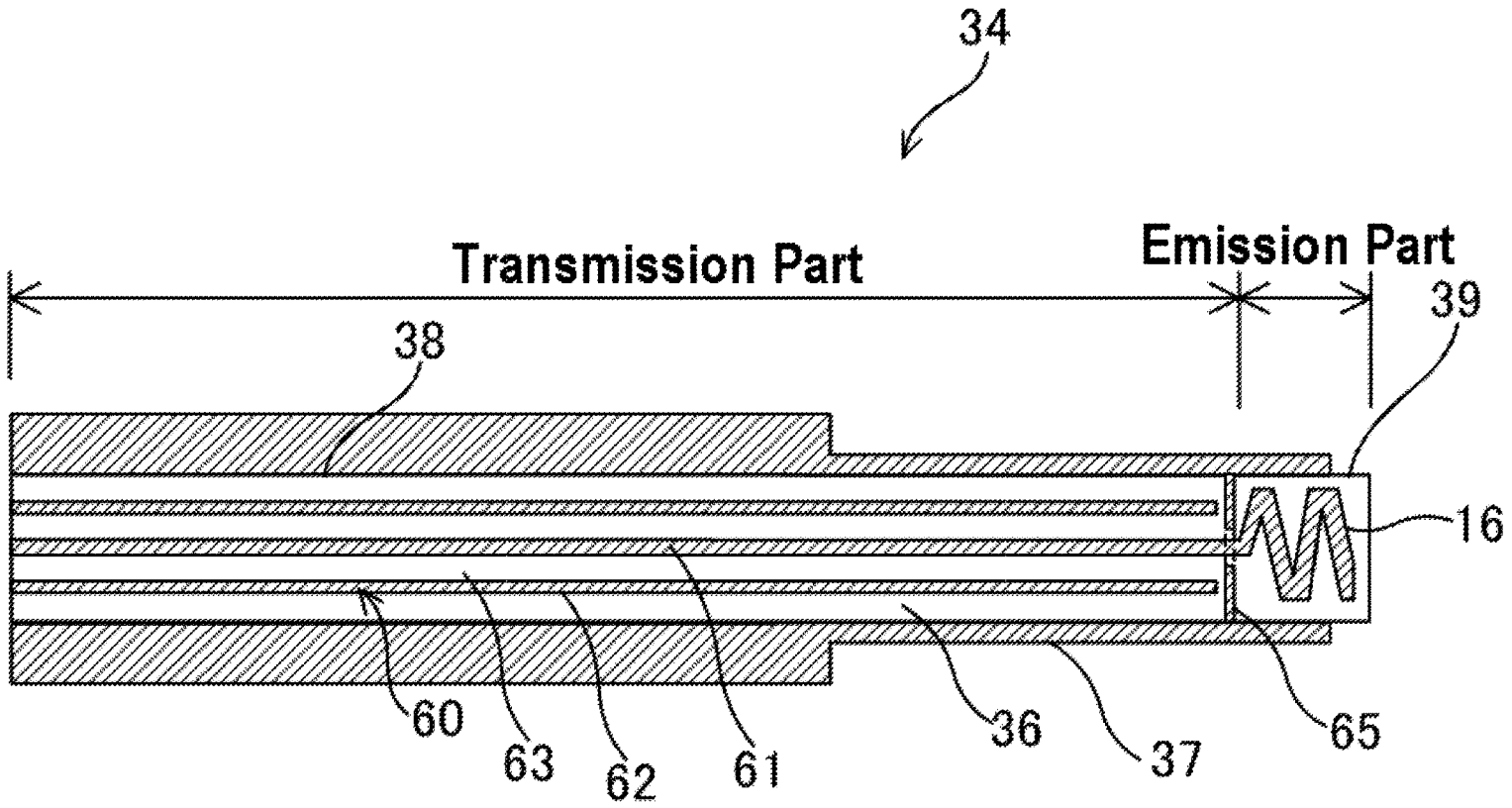
FIG. 6 is a vertical cross sectional view of another configuration of the plug for high frequency emission according to the modified example of the embodiment.

As shown in FIG. 6, the plate-like conductor 65 may abut with the casing 37 alone from among the outer conductor 62 and the casing 37. Furthermore, the plate-like conductor 65 may be held in non-contact with both the outer conductor 62 and the casing 37.

<Other Embodiments>

The embodiment described above may also be configured as follows.

In the embodiment described above, the central conductor 61 is integral with the emission antenna 16. However, the central conductor 61 may be capacitively coupled with the emission antenna 16.

Furthermore, in the embodiment described above, the internal combustion engine main body 11 may be provided with a plurality of the plugs for high frequency emission 34.

INDUSTRIAL APPLICABILITY

The present invention is useful in relation to a plug for high frequency emission provided at one end of a casing thereof with an emission antenna.

EXPLANATION OF REFERENCE NUMERALS

10 Internal Combustion Engine
11 Internal Combustion Engine Main Body
16 Emission Antenna
34 Plug for High Frequency Emission
36 Ceramic Structure
37 Casing
60 Transmission Line
61 Central Conductor
62 Outer Conductor
63 Ceramic (Insulator)

What is claimed is:

1. A plug for high frequency emission, comprising:

a central conductor and an outer conductor which is located apart from and surrounding the central conductor, which constitute a transmission line part of the plug for transmitting an electromagnetic wave;

an emission antenna electrically connected to the central conductor and configured to emit the electromagnetic wave supplied via the transmission line;

an insulator;

a casing constituted by a cylindrical shaped conductor and housing therein the central conductor, the outer conductor, and the insulator, where the emission antenna is provided at one end of the casing, and accommodating the transmission line that extends from the emission antenna toward the other end of the casing, wherein inside of the casing, each of the central conductor and the outer conductor is embedded in the insulator throughout the transmission line part, such that the outer conductor is disposed in the casing in a manner to be held in non-contact with the casing by being embedded in the insulator; and, wherein a plate-like conductor is embedded between the emission antenna and the outer conductor in the insulator of the transmission line in a manner to be held in non-contact with the central conductor without electrically connecting between the outer conductor and the casing, the plate-like conductor being greater in area than an end surface of the outer conductor on a side of the emission antenna.

2. The plug for high frequency emission according to claim 1, wherein the plate-like conductor is formed in a shape of a ring or a letter C, and is embedded in the insulator in a manner to surround the central conductor.

* * * * *